US005532661A

United States Patent [19]

Lagerlöf

[11] Patent Number: 5,532,661

[45] Date of Patent: Jul. 2, 1996

[54] DEVICE FOR DISTRIBUTION OF MICROWAVE SIGNALS

[75] Inventor: Rolf Lagerlöf, Mölnlycke, Sweden

[73] Assignee: Telefonaktiebolaget LM Ericsson, Stockholm, Sweden

[21] Appl. No.: 421,973

[22] Filed: Apr. 14, 1995

[30] Foreign Application Priority Data

Apr. 15, 1994 [SE] Sweden ..... 9401280

[51] Int. Cl.[6] ..... H01P 5/12

[52] U.S. Cl. ..... 333/125; 333/137

[58] Field of Search ..... 333/117, 122, 333/125, 126, 135, 137

[56] References Cited

U.S. PATENT DOCUMENTS 2,514,678 7/1950 Southworth ..... 333/125 X 2,848,689 8/1958 Zaleski ..... 333/125

FOREIGN PATENT DOCUMENTS 55-14757 2/1980 Japan .

59-132203 1/1983 Japan .

59-132202 2/1983 Japan .

*Primary Examiner*—Paul Gensler

*Attorney, Agent, or Firm*—Burns, Doane, Swecker & Mathis

[57] ABSTRACT

A waveguide device non-uniformly distributes in the magnetic plane a microwave signal from a first waveguide between a second and a third waveguide. The second and third waveguides are arranged parallel to each other and separated by a partition wall, and are terminated at one of their ends by shoulder walls in which an opening is arranged. The first waveguide is attached to this opening. The opening and the first waveguide are displaced sideways with respect to the longitudinal direction of the partition wall.

3 Claims, 2 Drawing Sheets

DEVICE FOR DISTRIBUTION OF MICROWAVE SIGNALS

BACKGROUND

The present invention relates to a device that distributes a microwave signal in a waveguide between two waveguide branches.

For transfer of microwaves, transmission lines consisting of waveguides and different waveguide components are used. So called T-junctions are such components that are used when a microwave signal is to be split between two outputs. Cascade connections of several T-junctions make a distribution among more outputs possible.

In those cases in which the power is to be divided equally among the outputs, this is achieved with a symmetrical junction. In many cases however a non-uniform distribution is desired, for example the power at the outputs should differ 4 dB within a specified frequency range.

The division can occur either in the electrical field plane, i.e. the E-plane or in the magnetic field plane, i.e. the H-plane. Distribution via an E-plane junction is easily done by varying the size of the openings of the connected waveguides, in principle in proportion to the power that is to be guided to respective outputs. The dividing wall is perpendicular to the electrical field, and does not cause much disturbance of the field in the waveguide.

This is not as easily accomplished in the H-plane. A dividing wall becomes parallel with the electrical field in this case, and thus creates a considerable disturbance. Furthermore, it is the H-plane dimension, the so called a-measure (the width of the waveguide), that dictates the propagation constant in the waveguide. It has been shown in trials that the distribution relationship becomes frequency dependent, which in many applications cannot be accepted or in any case leads to deteriorated characteristics.

With these types of constructions there are also demands on matching of the "port" through which input of the microwave signal occurs, and also often demands of phase uniformity between the output ports. This can be accomplished with different impedance matching structures that are placed in the waveguides. An example of such an impedance matching structure can be found in the Japanese patent document JP55-14757. In this case the impedance matching structure is also used for distribution of the microwave signals in the junction. However, by using only a single structure it can be difficult to decide the power distribution as well as the matching, and at the same time achieve sufficiently wide bandwidth.

SUMMARY

An object with the device of the present invention is to provide a waveguide branch in the H-plane by means of which a microwave signal can be distributed non-uniformly between two "branches". The distribution is to be independent of the frequency within as large a frequency range as possible and the waveguide junction is also to be simple to manufacture.

Said objects are attained according to the invention by means of an asymmetric connection of the input waveguide of the junction to the two parallel output waveguides ("branches") of the junction. The non-uniform division of the signal is hereby attained due to the connection being laterally asymmetric in relation to the parallel output waveguides. By also shifting the two output waveguides longitudinally in relation to each other when connecting the input waveguide, a reduced frequency dependency of the distribution is attained.

Matching of the impedance of the input is done in a simple way by changing the width of the waveguide where the input waveguide is connected to the output waveguides.

When a device according to the invention lacks internal impedance-matching structures in the form of steps, reactance "taps" etc., it becomes simple to manufacture.

DETAILED DESCRIPTION

With reference to FIGS. 1 to 5, the invention will now be described in greater detail.

Figure 1:
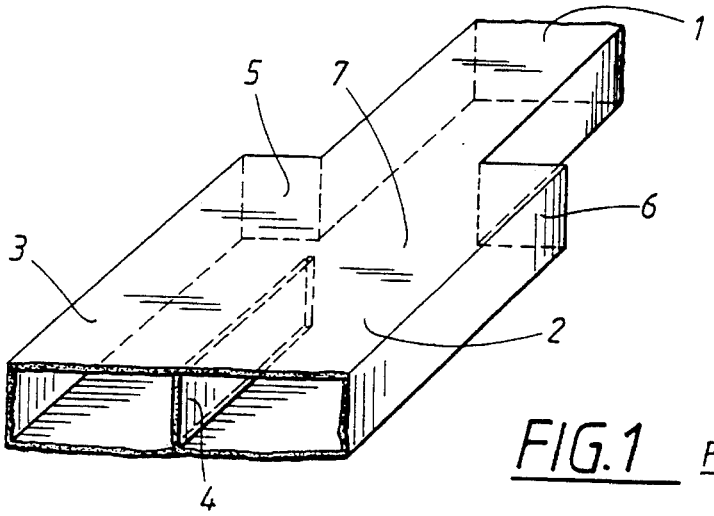
FIG.1 PRIOR ART
FIG. 1 shows a symmetrical, straight, H-plane waveguide junction of a conventional type.
Figure 2:
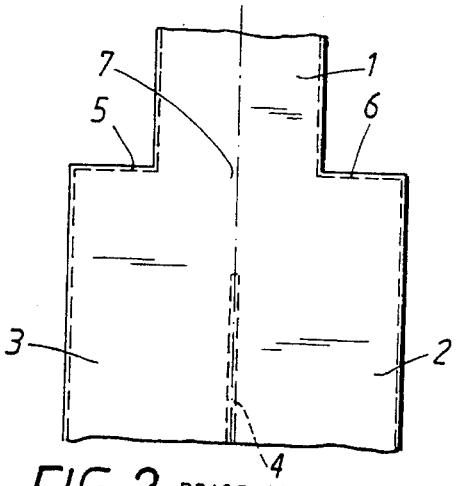
FIG.2 PRIOR ART
FIG. 2 shows a top view of the waveguide junction of FIG. 1.

FIG. 1 shows a straight waveguide junction consisting of a first waveguide, the input waveguide 1, and two parallel waveguides, the output waveguides 2 and 3. In the end facing the input waveguide 1, the output waveguides 2 and 3 are terminated with shoulder walls 6 and 5 respectively. An opening 7 is arranged in the shoulder walls to which the input waveguide 1 is connected. Opening 7 is of the same size as the cross-sectional opening of the input waveguide and is symmetrically placed so that the shoulder walls 5 and 6 are of the same size. The two output waveguides are separated by a partition wall 4. The length of the partition wall is shorter than that of the output waveguides and because of this does not reach the opening 7. The distance between the end of the partition wall that faces opening 7 and the opening is in the region of ¼ wave length, though the distance can be varied to match the waveguide impedances and reduce reflections against the end surface of the partition wall. The waveguide junction of FIG. 1 is also shown in FIG. 2 but in the form of a plan view.

The microwave signal in the input waveguide 1 will be distributed equally in this waveguide junction between the two output waveguides 2 and 3 as far as power is concerned.

Figure 3:
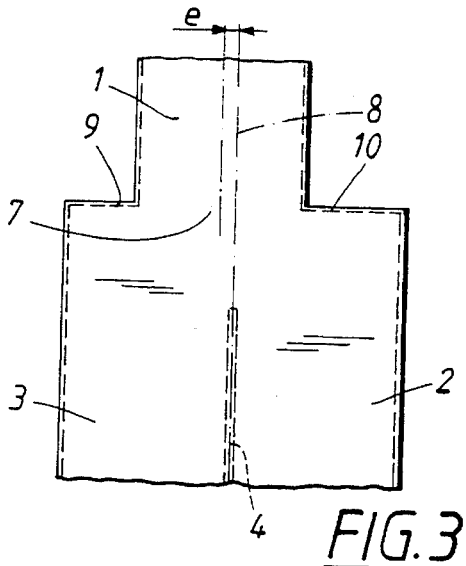
FIG. 3 shows a straight, H-plane waveguide junction with a sideways offset input waveguide.

As is shown in FIG. 3, by shifting the input waveguide sideways a distance e from the centre line 8 of the waveguide junction through the partition wall, an asymmetric waveguide junction is obtained. The opening 7 is of the same size as that in the previously described device but because of the asymmetric placement, the shoulder walls become unequal in size and will therefore be referenced as 9 and 10 respectively. The microwave signal in the input waveguide 1 is distributed in dependence of the asymmetric placement of the input waveguide asymmetrically between the output waveguides.

Figure 6:
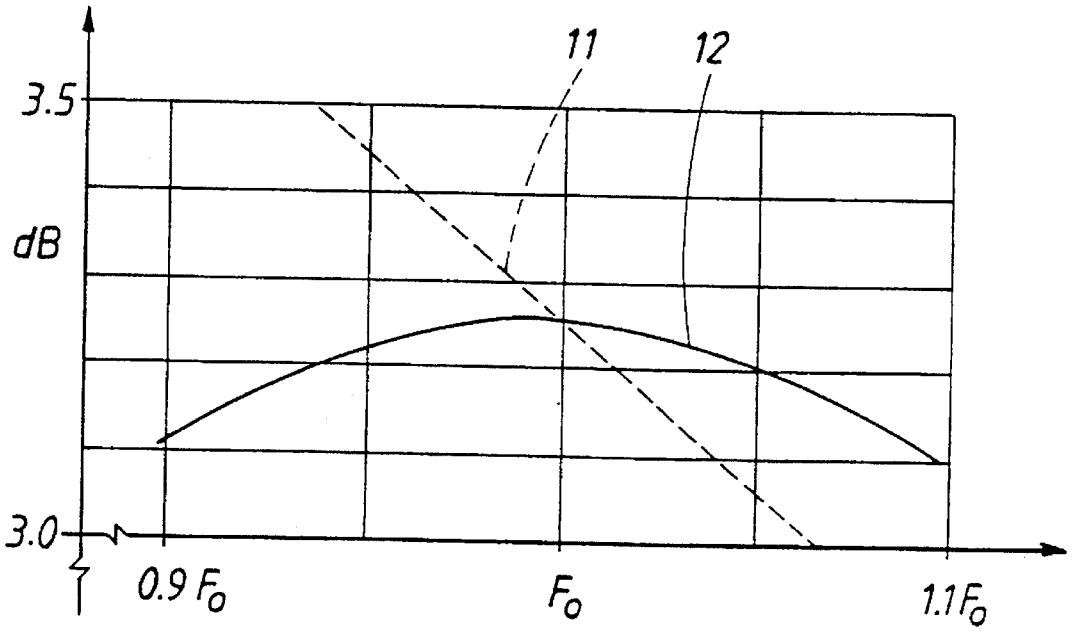
FIG. 6 shows in a diagrammatic form an example of the frequency dependency of a power distribution of a waveguide junction according to FIG. 3 and for a waveguide junction according to the invention.

Such a waveguide junction has however a frequency dependent distribution. FIG. 6 shows a diagram whose X-axis represents frequency and whose Y-axis represents the relationship (in dB) between the division of the power of the microwave signal between the two output waveguides. The curve 11 shows an example of the frequency dependent division that is attained with the waveguide junction described in connection with FIG. 3. The junction is assumed to be optimized for the frequency $F_0$ and the relationship between the power of the microwave signal in the output waveguides is then 3.25 dB. As is apparent from the diagram, the distribution varies considerably as a function of frequency.

Figure 4:
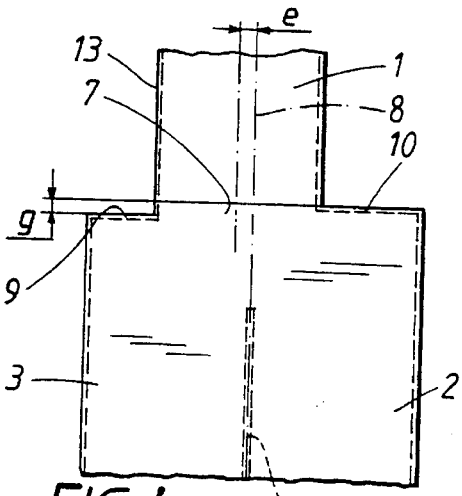
FIG. 4 shows an embodiment of a waveguide junction according to the invention.

It is however possible, in an alternative embodiment of the invention, to decrease the frequency dependency. FIG. 4 shows such an embodiment. The smaller waveguide shoulder wall 9 has here been moved in the longitudinal direction of the output waveguide in such a way that one side 13 of the input waveguide is extended. In the longitudinal direction of the junction, the two shoulder walls are then at a distance g from each other.

By this displacement of the position of one of the shoulder walls the frequency dependency of the waveguide junction is considerably improved. In FIG. 6 the curve 12 depicts the frequency dependency of the power division for a junction according to the presently described embodiment. As is evident from the drawing, the division can almost be considered as constant within a relatively large frequency range.

Figure 5:
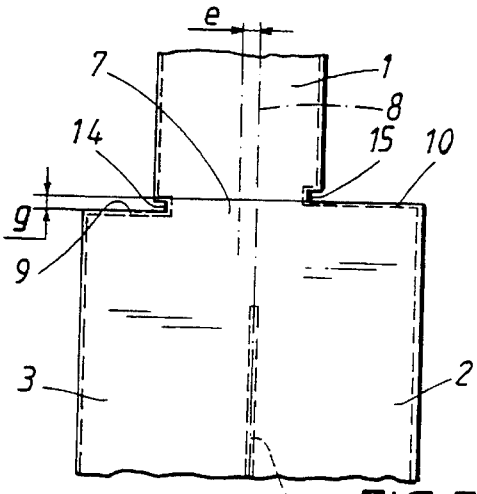
FIG. 5 shows a second embodiment of a waveguide junction according to the invention.

Further improvements of the characteristics of the waveguide junction according to the invention are possible. FIG. 5 corresponds to the embodiment according to FIG. 4, but the width of the opening 7 has been made smaller than the width of the input waveguide 1. The reduction of the opening has been done by extending the shoulder walls 9 and 10. Due to this, an asymmetric diaphragm is formed in the opening 7. By varying the dimensions of the "laminae" 14 and 15 of the diaphragm, a better matching between input and output waveguides can be achieved. With regard to this, both the height (the width of the opening) of the laminae as well as their extension longitudinally in the waveguide junction can be varied.

As an example of the values of the distances e and g for different power divisions, the following values can be disclosed where a is the width of the waveguide.

| Power division (dB) | e/a | g/a |
|---|---|---|
| 0 | 0 | 0 |
| 2 | 0.08 | 0.04 |
| 4 | 0.16 | 0.08 |
| 6 | 0.24 | 0.13 |

It is apparent from the table that the distance e basically is equal to twice the distance g.

By means of the described embodiments of the invention, it is possible with respect to amplitude and phase to distribute a microwave signal non-uniformly between two waveguides where a relationship between the distributed signals of more than 10 dB can be attained.

The waveguide junction according to the invention consequently lacks complicated inner structures for matching and adjustment. Nor are different materials included, instead the whole junction can easily be manufactured in one piece, for example moulded in aluminium. Because of this it can be easily and cheaply manufactured and it does not require any subsequent electrical adjustments.

The invention is not limited to the described embodiments, but may be varied within the scope of the appended claims.

What is claimed is:

1. A waveguide device for non-uniformly distributing in a magnetic plane a microwave signal, the waveguide device comprising:

a first waveguide, a second waveguide, and a third waveguide, wherein the microwave signal from the first waveguide is distributed between the second waveguide and the third waveguide; the second and third waveguides are placed parallel to each other, are separated by a partition wall, and are terminated at one end by shoulder walls in which an opening is arranged to which the first waveguide is connected; the opening and the first waveguide are displaced sideways in relation to a longitudinal direction of the partition wall; and the shoulder walls in relation to each other are displaced in the longitudinal direction of the waveguides.

2. A waveguide device for non-uniformly distributing in a magnetic plane a microwave signal, the waveguide device comprising:

a first waveguide, a second waveguide, and a third waveguide, wherein the microwave signal from the first waveguide is distributed between the second waveguide and the third waveguide; the second and third waveguides are placed parallel to each other, are separated by a partition wall, and are terminated at one end by shoulder walls in which an opening is arranged to which the first waveguide is connected; the opening and the first waveguide are displaced sideways in relation to a longitudinal direction of the partition wall; the shoulder walls in relation to each other are displaced in the longitudinal direction of the waveguides; and the sideways displacement of the first waveguide in relation to the longitudinal direction of the partition wall is in the order of twice the displacement between the shoulder walls.

3. A waveguide device for non-uniformly distributing in a magnetic plane a microwave signal, the waveguide device comprising:

a first waveguide, a second waveguide, and a third waveguide, wherein the microwave signal from the first waveguide is distributed between the second waveguide and the third waveguide; the second and third waveguides are placed parallel to each other, are separated by a partition wall, and are terminated at one end by shoulder walls in which an opening is arranged to which the first waveguide is connected; the opening and the first waveguide are displaced sideways in relation to a longitudinal direction of the partition wall; and the shoulder walls in relation to each other are displaced in the longitudinal direction of the waveguides; and a width of the opening is less than a width of the first waveguide.

* * * * *